US005537937A

United States Patent [19]

Juvik-Woods

[11] Patent Number: 5,537,937

[45] Date of Patent: Jul. 23, 1996

[54] COMPOSITED FOUR-WAY PAPER CARGO PALLET

[75] Inventor: Harry C. Juvik-Woods, San Rafael, Calif.

[73] Assignee: Damage Prevention Products, Inc., Benicia, Calif.

[21] Appl. No.: 76,732

[22] Filed: Jun. 14, 1993

[51] Int. Cl.[6] ..... B65D 19/00

[52] U.S. Cl. ..... 108/51.3; 108/56.3

[58] Field of Search ..... 108/51.3, 51.1, 108/56.1, 56.3

[56] References Cited

U.S. PATENT DOCUMENTS

| | | | |
|---|---|---|---|
| 3,685,463 | 8/1972 | Francis | 108/56.3 X |
| 4,378,743 | 4/1983 | McFalland | 108/56.3 X |
| 4,765,252 | 8/1988 | Shuert | 108/56.1 X |
| 4,790,249 | 12/1988 | Webb | 108/51.3 |
| 5,076,176 | 12/1991 | Clasen | 108/51.3 |
| 5,121,696 | 6/1992 | Harder | 108/51.3 |
| 5,213,050 | 5/1993 | Juvik-Woods | 108/51.3 |

FOREIGN PATENT DOCUMENTS

| | | | |
|---|---|---|---|
| 0474540 | 7/1992 | European Pat. Off. | 108/51.3 |
| 7508867 | 10/1976 | France | 108/51.3 |

*Primary Examiner*—Jose V. Chen
*Attorney, Agent, or Firm*—E. Thomas Wheelock

[57] ABSTRACT

This is a pallet as might be used to support cargo during that cargo's transportation or storage. The pallet is constructed of paper. The pallet design involves a central platform or deck constructed of a honeycomb filler supported by a set of runners extending from one edge of the central platform to the other and is bounded on all of the bottom surfaces by a single corrugated sheet. The runners are then modified by cutting away appropriate portions to form a four way pallet. The cut portions are then reinforced by addition of reinforcing corrugated sheets. The upper surface of the central platform may be covered with a corrugated sheet or heavy sheet stock. Additionally, the upper and/or lower sheets may be folded over the edges of the honeycomb core and fastened to the other side. This design permits a flexible and inexpensive method of producing either four- or two-way pallets.

17 Claims, 6 Drawing Sheets

COMPOSITED FOUR-WAY PAPER CARGO PALLET

FIELD OF THE INVENTION

This invention is a pallet as might be used to support cargo during that cargo's transportation or storage. The pallet is constructed of paper and adhesive. The pallet design involves a central platform or deck constructed of a honeycomb filler supported by a set of runners extending form one edge of the central platform to the other and is bounded on all of the bottom surfaces by a single corrugated sheet. The runners are then modified by cutting away appropriate portions to form a four way pallet. The cut portions are then reinforced by addition of reinforcing corrugated sheets. The upper surface of the central platform may be covered with a corrugated sheet or heavy sheet stock. Additionally, the upper and/or lower sheets may be folded over the edges of the honeycomb core and fastened to the other side. This design permits a flexible and inexpensive method of producing both four- and two-way pallets.

BACKGROUND OF THE INVENTION

A pallet is a portable, horizontal, rigid, platform used as a base for assembling, storing, stacking, handling goods as a unit load. Conventional pallets are typically constructed of wood and are made by stapling or nailing a number of boards (known as "deckboards") at their ends to a number of continuous solid boards (known as "stringers"). The upper set and lower set (where used) of deckboards thereby form an open area defined by the thickness of the stringers. This opening is used to accommodate a fork lift or hand truck. In this way the pallet may be moved from place to place by lifting the pallet and its load off the floor.

The vast majority of all pallets used in the U.S. are constructed of wood, but wood pallets have many disadvantages. Labor and material costs for wooden pallets have increased faster than inflation. Because of their expense, the pallets are often reused or returned to their place of origin. The cost of returning empty pallets to their owners is obviously high. Additionally, The average weight of a wooden pallet is about forty pounds. Since shipping costs are usually tied to the weight of the goods shipped, the cost of shipping is increased by the weight of the pallet. Indeed, pallets are sufficiently heavy that smaller warehouse workers are able manually to move the pallets only with some difficulty. Wooden pallets are often damaged during use and, because of the pallet cost, must be repaired if possible or disposed of. Depending upon the industry involved, pallets may be used between two and four times before they are disposed of. Disposal of any solid materials including broken pallets is an increasingly difficult and costly problem.

The invention is a pallet constructed of paper or other lightweight sheet materials and includes a central platform or deck constructed of a honeycomb filler bounded on the bottom surface by a continuous corrugated sheet which covers the supporting legs or runners so to form a continuous cover over the entire bottom surface. The upper surface of the central platform may be covered with a corrugated sheet or heavy sheet stock. Additionally, the upper and/or lower sheets may be folded over the edges of the honeycomb core and fastened to their opposite sides. The runners or legs which are included to support the central platform are cut to transform the two-way pallet to a four-way design. One or more specifically conformed bottom sheets are then adhesively mounted to the bottomside of the pallet to strengthen and reinforce it. In addition to the inherent strength and low cost of the finally assembled pallet, by careful selection of construction materials, the design may be completely recycled as paper without separation into constituent parts.

There are a number of pallet designs which are made mostly of paper. For instance, U.S. Pat. No. 3,661,099, to Shelor, shows a paper shipping pallet having a deck having a core section made of small strips cut from single, double, or triple wall corrugated paper board sheet stock glued face to face. Sheets of corrugated are glued to the longitudinal edges of the composite core. The core and facing sheets are desirably of a specific size of corrugated sheets, i.e., having a size "A" flute or better. The legs of the pallet appear to be wooden blocks.

U.S. Pat. No. 3,650,459, to Tucker, shows a paper pallet design involving a folded corrugate sheet as the cargo support area. That cargo deck is provided with a number of pallet feet (which operate as spacer blocks within the cargo deck) made of molded plastic material such as polystyrene. The use of a honeycomb core within the cargo support area is not disclosed.

U.S. Pat. No. 3,952,672, to Gordon et al, shows a disposable pallet made of a single folded corrugated sheet. The use of a honeycomb core on the cargo support area is not disclosed.

U.S. Pat. Nos. 4,867,074 and 5,001,991, to Smith, each show a pallet design in which the cargo deck is made up of a large number of girders folded from corrugated sheet and assembled with a series of cross girders. The use of a honeycomb core in the cargo support area is not disclosed.

U.S. Pat. No. 4,790,249, to Webb, shows a pallet design in which the cargo deck is made up of facing sheets separated by a number of blocks having a specific design. The block design involves a cellulosic material glued together by a bonding material (such as ureaformaldehyde) all extruded into the shape of a box beam. The boxes are positioned so to protect the deck from the tines on a fork lift.

Netherlands Patent Application 83-00024 shows an interesting design for a paper pallet. The cargo support deck appears to be constructed of a number of loops of paper glued together at a number of sites within the deck and also glued to a periphery forming the edge of the deck. Neither the use of a honeycomb core nor the use of corrugated sheet in the cargo deck support area is disclosed.

There are few disclosures showing the use of honeycomb materials in the core of the cargo support deck.

One such disclosure is Published U.K. Patent Application 2,213,462-A to Green et al. This published application shows a paper pallet design in which the cargo deck is made up of two face sheets of, e.g., corrugated cardboard and having a an open structure such as a paper or card honeycomb between them. It is said that the deck may be raised from the floor using feet of similar construction. The deck core is made to be penetrable by the tines of a fork lift. The disclosure is silent on the use of a corrugated sheet folded over the edge of the central core and fastened to the opposite side.

U.S. Pat. No. 4,319,530, to Moog, discloses a pallet, said to be disposable, having a cargo supporting deck area made up of a central core of a honeycomb made of laminated corrugate. The core is faced with one or more corrugated sheets glued to the core. The facing on the cargo support surface of the central core may be made up of multiple layers of corrugated sheets. The disclosure is silent on the use of a corrugated sheet folded over the edge of the central core and fastened to the opposite side nor, obviously, is any benefit accorded such a folded sheet.

None of these disclosures show a pallet constructed of paper involving a central platform or deck constructed of a honeycomb filler bounded on the top and bottom surfaces by corrugated sheets nor do these disclosures show the feature of increased physical stability due to the integration of the lower surface as support for the central platform. Finally, none of these publications show the production of a four-way pallet by the modification of a two-way pallet in the manner specified herein nor do these publications show the structure of the resulting device.

SUMMARY OF THE INVENTION

In general, this invention is a pallet as might be used to support cargo during that cargo's transportation or storage. The pallet is constructed of paper. The pallet design involves a central platform constructed of a honeycomb filler. The upper surface of the central platform may be bounded on the upper surface by corrugate or paper or other suitable covering. The lower surface of the central platform is bounded by longitudinal runners or legs, particularly those utilizing honeycomb or corrugate cores and corrugate skins and adapted so that the skins overlap up on to the edges of the central platform. The longitudinal runners in the basic two-way pallet are then notched to form a four-way pallet. Lower covers having specific forms are then applied to the bottom surface to provide support and strength to the pallet.

Although the invention may be made of a variety of materials, I prefer to construct the pallet from materials which may be readily recycled using commercially available technology. For instance, the various sheet material is desirably from kraft paper or other similar paper stock. Of course, depending upon the service into which the pallet is placed, other materials may be selected, e.g., MYLAR, polyethylene, polypropylene (clear or fibrous paper product), or the like is acceptable. Some thermosetting polymeric materials are not currently widely recyclable and, from that viewpoint, may not be the best of choices for the pallet. However even with nonrecyclable materials the improvements of the pallet design will be apparent. Choice of materials and methods to join together the various components of the pallet may also be made on the basis of recyclability. For instance, most water-based glues, e.g., hide glue, mucilage, etc. are glues compatible with the kraft paper recycling processes. The use of heat sealing thermoplastic materials such as polypropylene is an expedient using no adhesive.

Figure 1:
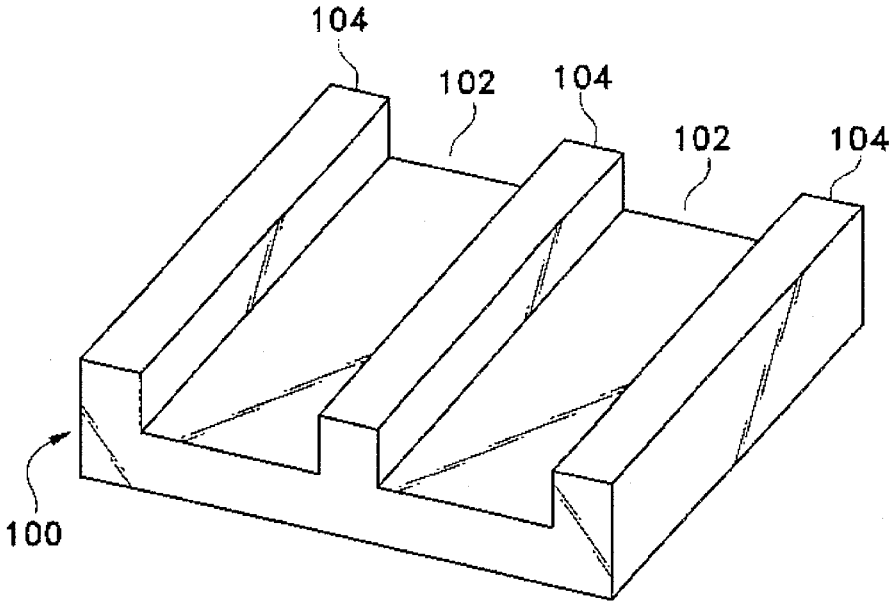
FIG. 1 is a bottom perspective view of a two-way cardboard pallet suitable as a substrate for the inventive pallet.

FIG. 1 is a bottom perspective view of a two-way paper pallet, shown generally as (100), which may be used as the substrate for the current invention. This substrate is desirably a two way pallet made according to the disclosure of U.S. patent Ser. No. 07/904,990, filed Jun. 26, 1992, entitled "INTEGRATED TWO-WAY PAPER CARGO PALLET". The wide slots (102) between the runners (104) on the underside of the cargo deck permit entry of forklift or hand truck tines from either of opposite ends.

Figure 2:
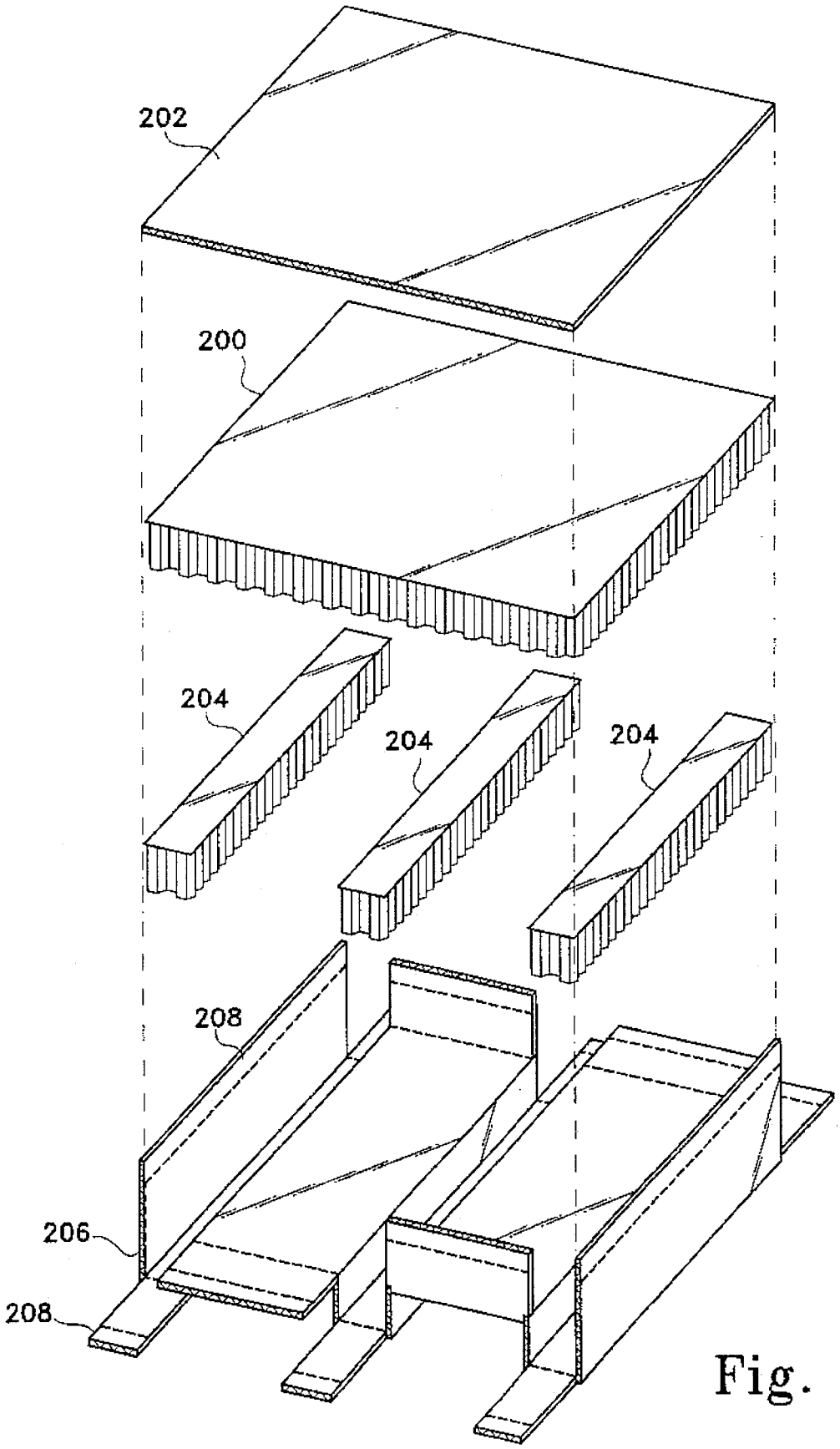
FIG. 2 is an exploded diagram showing the components of one basic configuration of the two-way pallet forming the substrate of this invention.

FIG. 2 is an exploded diagram showing the components of one basic configuration of the two-way pallet forming the substrate of this invention. In this configuration, the central core (200) comprises an expanded honeycomb material. Joined to this core on the upper face of the core is a facing sheet (202). The facing sheet may be of a corrugate or a sheet of a suitable material such as paper. This variation of the pallet uses a lower corrugate sheet which is integrated with the runners supporting the core (200) to enhance the overall strength of the pallet. The runners and the lower deck facing are made of a set of runner cores (204) of expanded honeycomb or multilaminate corrugate and a lower folded corrugate sheet (206). The runners are separated from each other on the lower face of the core and cover at least a portion of that lower face. They run from one edge of the deck transversely to the opposite edge. The lower corrugated folded sheet (206) adheres to and encloses the runner core blocks (204). It also has tabs (208) which may be folded over and allow it to adhere to the cargo (or upper) surface of the upper face (202).

It may be desirable to include a glue sheet (not shown) between runner core blocks (210) and core deck (200). Although it is not required, the glue sheet provides an enhanced surface to allow both better adhesive junctions between the two adjacent honeycomb blocks and closure of the cells in the honeycombs. Most commercial honeycomb materials include these sheets when they are produced. If the method for joining the various sheets to the core is properly carried out, the cells within the core are isolated from each other. The core strength is enhanced by the formation of these closed cells and imparts an amount of springiness and shock absorbing capabilities to the core.

The runners obviously cannot be separated from the deck without the virtually complete destruction of the pallet.

If the upper facing sheet (202) is a corrugate sheet, the flutes in the respective corrugated sheets (202, 206) may be positioned such that the flutes in sheet (202) are not parallel to the flutes in sheet (206). The angle between the respective flutes may between about 0° and 90°, but preferably is between 30° and 90°. For a very practical pallet from the vantage of strength, versatility, and ease of construction, an included angle between the flutes of about 90° is desirable.

Figure 3:
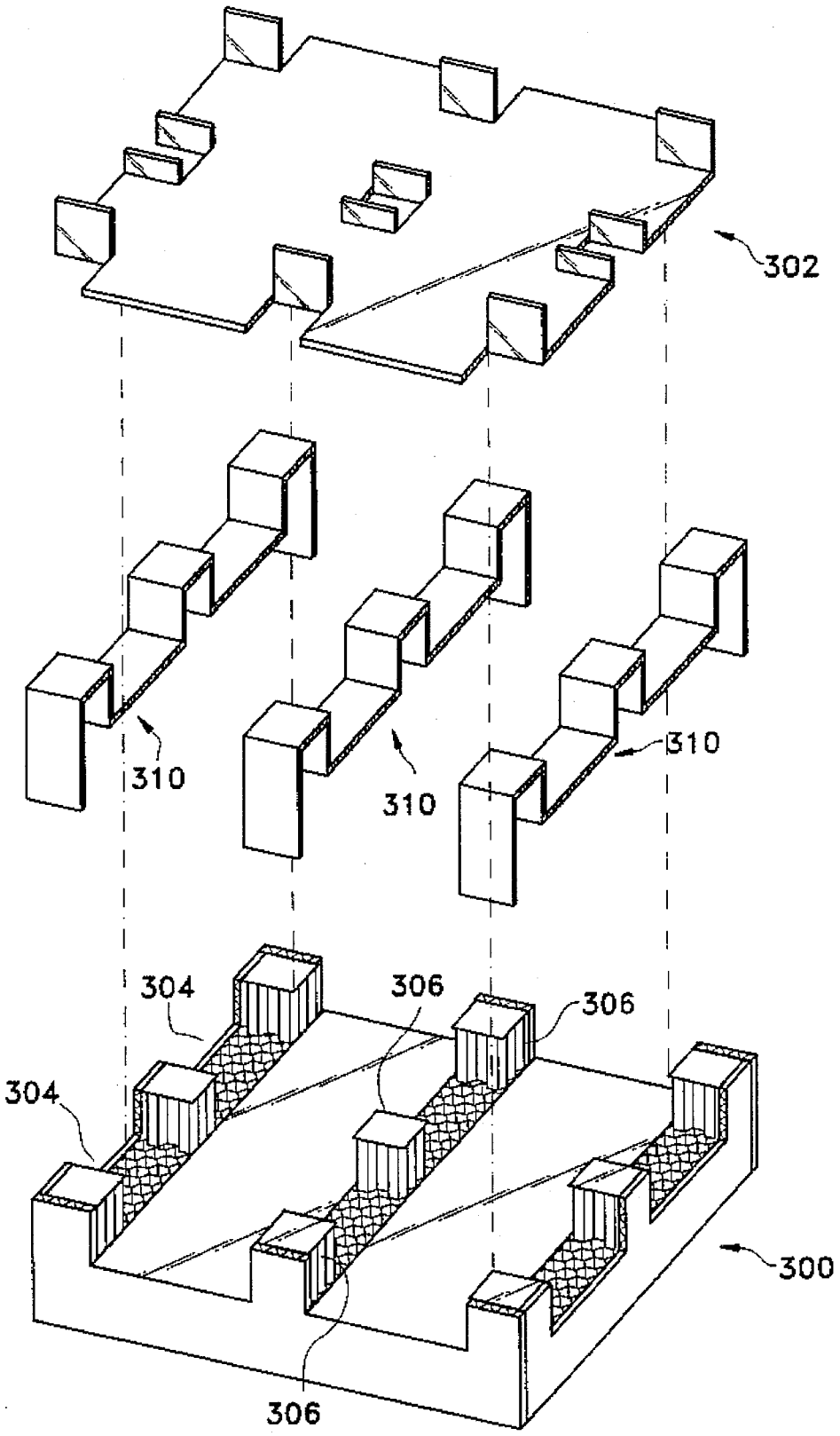
FIG. 3 is an exploded drawing of the components of the basic configuration of the invention.

FIG. 3 is an exploded view of a two-way pallet which has been formed into a four-way pallet substrate (300) by cutting blocks from the runners to form passageways (304) for the alternative entry direction into the resulting inventive four-way pallet. One variation of the conversion sheet (302) is shown on FIG. 3.

Foot covers (310) are preferably folded from a single sheet of corrugate having the width of the runners and placed onto the cutaway runners. The foot covers (310) meet with the sides of passageways (304) which have exposed honeycomb as a result of the step of cutting the blocks from the runners. The foot covers (310) also contact the underside of the deck also exposed by the cutting step. The foot covers (310) cover all of the various exposed honeycomb.

The conversion or key sheet (302) meets with the foot covers (310) and thence with the cutaway pallet substrate (300) in such a way that the key sheet (302) locks the foot covers (310) on place. Each of the foot covers (310) and the key sheet (302) are glued onto the next lower layer of the device.

Figure 4:
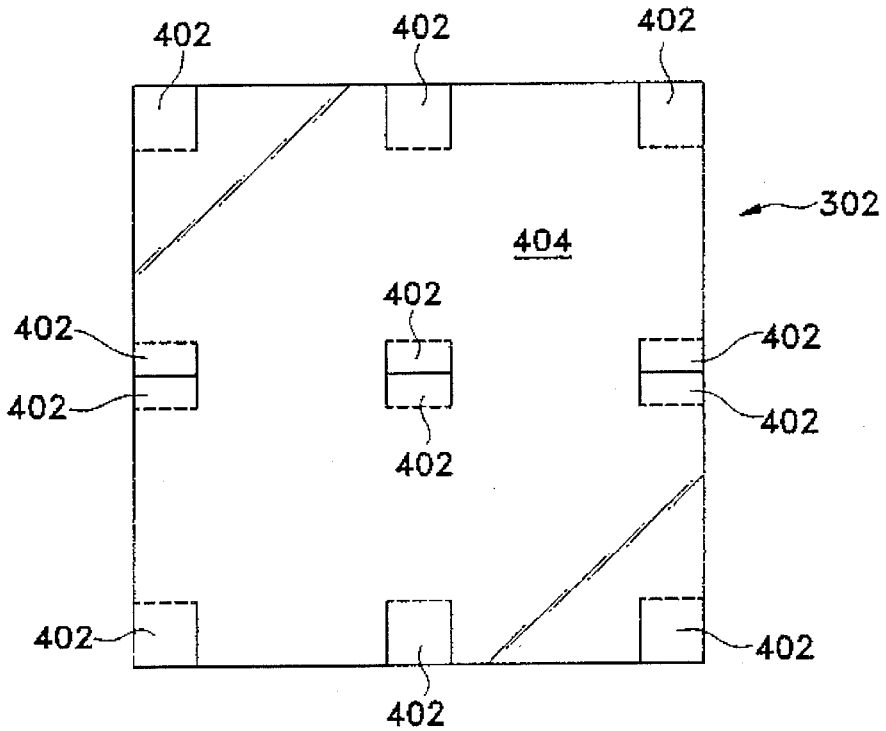
FIG. 4 shows a plan diagram of the lower sheet used in the FIG. 2 configuration.

FIG. 4 is a plan view of the conversion sheet (302) showing solid cut lines and dotted fold lines. Generally, the folded areas (402) fit against the folded foot covers (310) which are in turn in contact with the exposed honeycomb sides of the cutaway portion of the runner. The large area (404) fits flush against the bottom of the pallet substrate. Each area in which the conversion sheet (302) is in contact with the pallet substrate (300) may be used as a glue surface.

Figure 5:
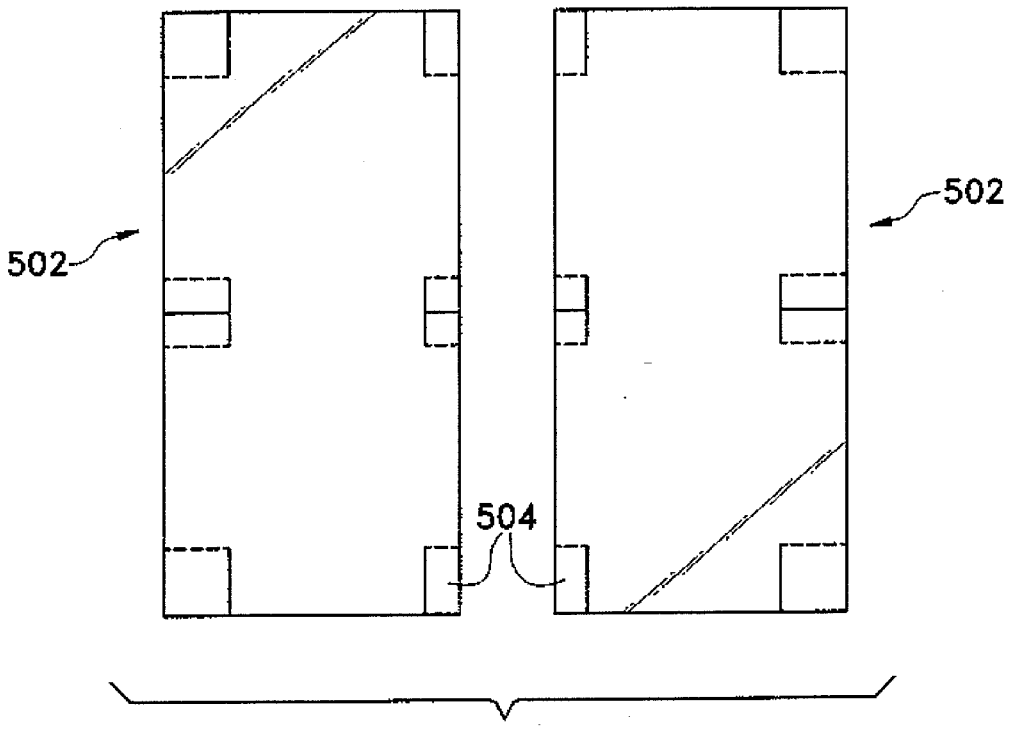
FIG. 5 shows a plan diagram of a two-part variation of the lower sheet used in the FIG. 2 configuration.

FIG. 5 shows a variation of the conversion sheet in which having two similar or mirror image portions (502) having similar glue surfaces, tabs and the like similar to the variation found in FIG. 4 when assembled into a sheet such as conversion sheet (302).

Figure 6:
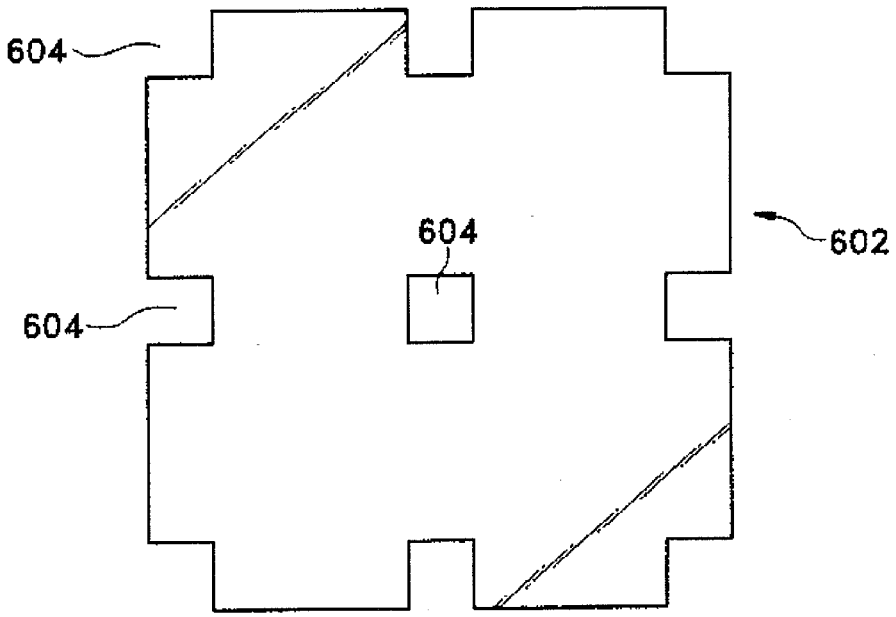
FIG. 6 shows a plan diagram of a variation of the lower sheet used in the FIG. 2 configuration.

FIG. 6 shows a plan view of variation of the conversion or key sheet (602) in which holes (604) are cut to fit over the feet remaining after the runners are cut. The key sheet (602) is glued to the underside of the pallet next to the bottom cover as shown at (206) in FIG. 2.

Figure 7:
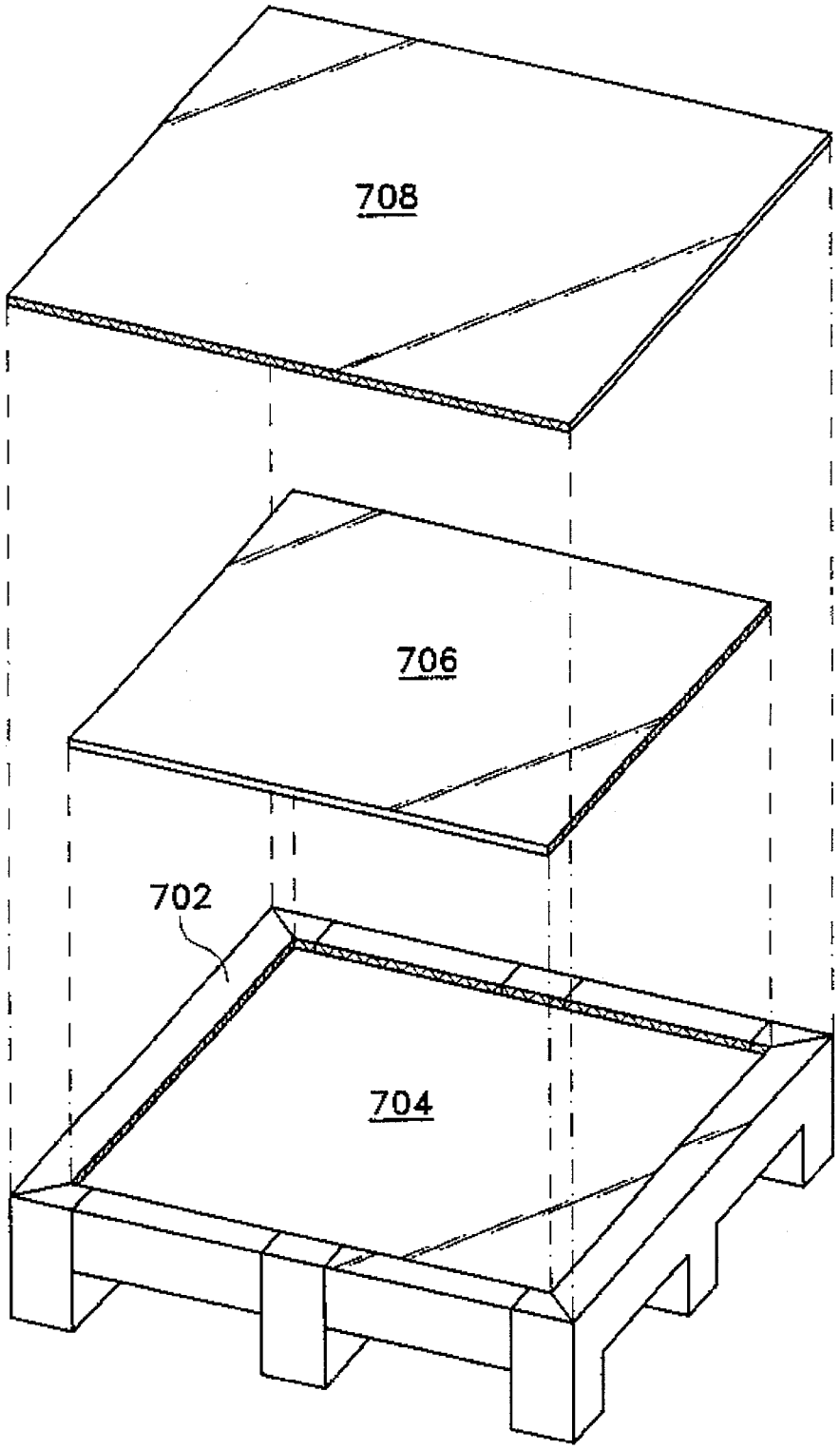
FIG. 7 shows a semi-exploded diagram of the top perspective of the pallet with filter sheets and upper cover sheet.

FIG. 7 a partially exploded perspective drawing of the top of a pallet made according to this invention (particularly with the wrapping shown in FIG. 2) in which there is a small amount of the lower wrap overlaps onto the top surface forming a small lip (702). The central area (704) is lower than the lip (702) by the thickness of the lip (702). The thickness of the depression is made up by gluing spacer sheet (706) to the central area (704). Addition of the spacer sheet (706) to the central area (704) contiguous to the lip (702) results in an upper surface which is completely flat.

A surface sheet (708) extending to the edge of the pallet upper surface may then be glued to that upper surface to enhance the impact resistance of the pallet deck. The resulting pallet is extraordinarily strong and without a seam on the top surface.

The pallet may be coated with a material which will harden or waterproof or dustproof the pallet. These materials may be chosen to meet whatever criteria are appropriate for the pallet use. For instance, if used in a humid atmosphere or used outside or are moved between refrigerated and non-refrigerated areas, waterproofing is desirable. Known water-based and oil-based materials may be applied as needed.

Additionally, the cargo face of the deck may be covered with or coated with a suitable material to prevent slippage of the cargo.

Figure 8:
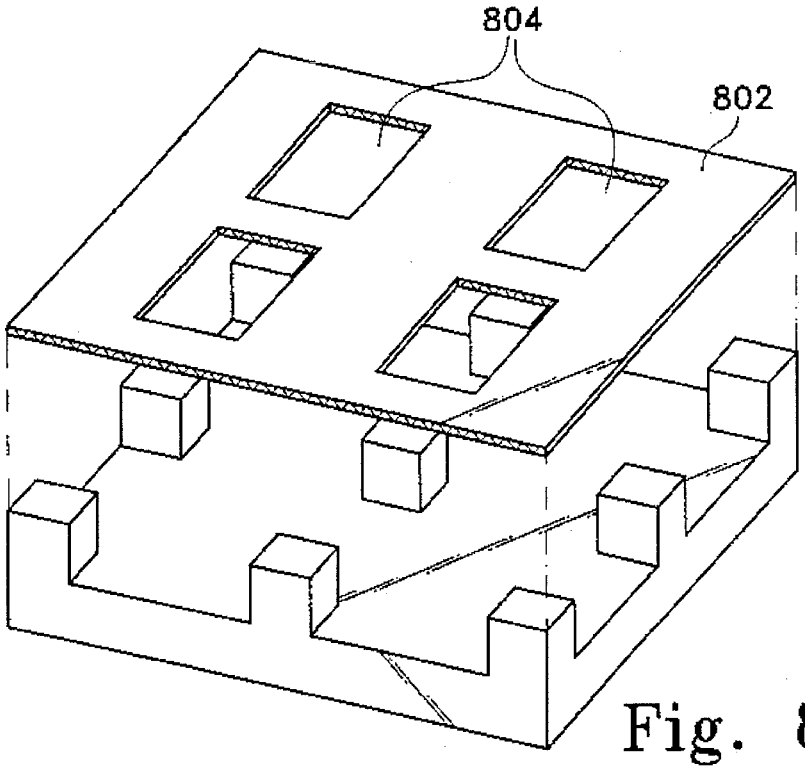
FIG. 8 shows a semi-exploded diagram of the bottom perspective of the pallet having a support sheet attached to the runners.

When the pallet of this invention is used in conjunction with roller conveyer systems, a hard thin sheet (802) such as paperboard, plywood, Masonite, hardened corrugate, etc. as is shown in FIG. 8, may be glued to the bottom of the runners. The sheet (802) is typically one-fourth to one-half inch in thickness. Paperboard is made from thin sheets of paper glued and compressed together to give a hard surface to the bottom of the runners. The hard surface prevents the bottom of the runners from depressing around the conveyer roller and thereby preventing the load-bearing pallet from rolling easily down the conveyer. The hard board provides adequate hardness for reducing the compressibility of the runner bottom and therefore reduces the drag on the pallet.

The footing sheet (802) may have holes (804) formed therein to allow use of pallet jacks on the pallet. The holes (804) accommodate wheels on pallet jacks to support the pallet once the pallet jack is raised.

Figure 9:
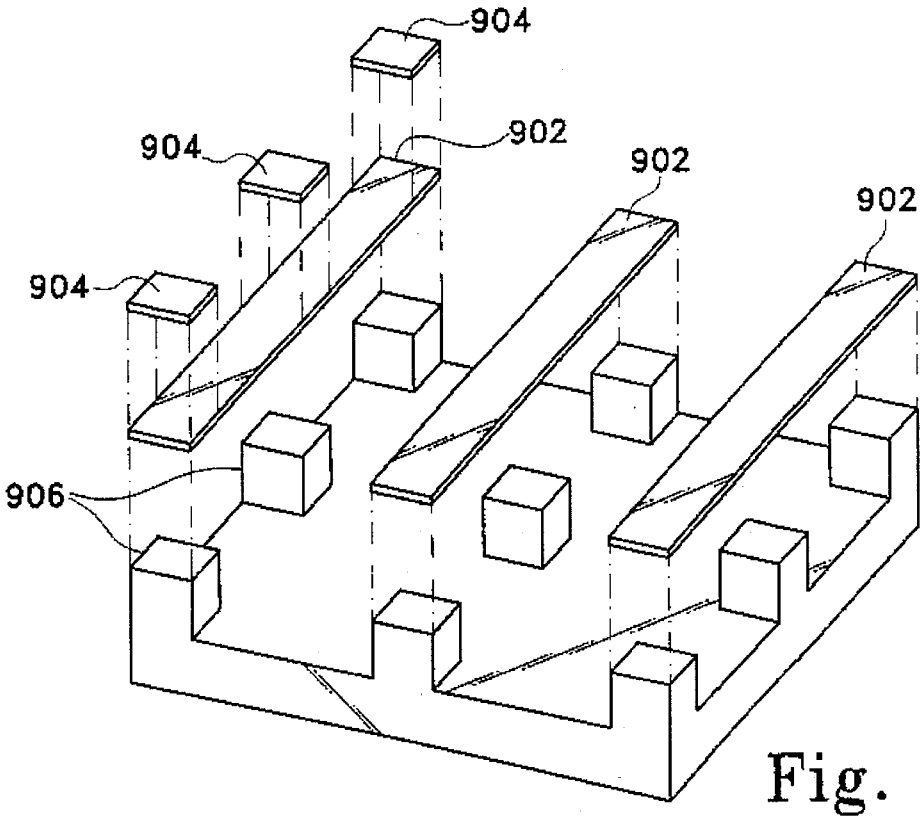
FIG. 9 shows a semi-exploded diagram of the bottom perspective of the pallet having support sheets attached to the runners.

FIG. 9 shows a variation of the pallet support sheets in which the long sheets (902) are glued to the lower edge of the blocks (906) cut from the runners. In addition to or instead of long sheets (902), shoe pieces (904) may be glued onto the bottom of the pallet blocks to support the pallet and provide a hard surface for use with conveyer systems.

It should be apparent that the number of runners is not a critical aspect of the inventive pallet. Similarly, the size and aspect ratios of the pallet described here are not important. This invention includes pallets using a variety of sizes and number of runners.

The invention has been described by description and by example. The examples are just examples and are not to be used to limit the scope of the invention in any way. Additionally, one having ordinary skill in this art will recognize variations and equivalents within the invention as described which will not necessarily be within the scope of the appended claims.

I claim as my Invention:

1. A pallet comprising:

a deck of a honeycomb core having an upper face, lower face, and edge;

an upper facing sheet adherent to the upper face of the honeycomb core deck, covered runners comprising, multiple runner blocks each having bottom and side surfaces, and said runner blocks being separated from each other and adhesively mounted to the lower face of the honeycomb core deck and covering at least a portion of the lower face, a single lower facing sheet comprising a corrugated sheet having flutes therein and adherent respectively to the bottom surfaces of each of the multiple runner blocks and extending upwardly from each said runner block bottom to cover and adhere to the side surfaces of each said runner block and further folded to cover the lower face of the honeycomb core deck, which covered runners have had portions of the runner blocks covered with the lower facing sheet cut away from the bottom surface to adjacent the lower face of the honeycomb core deck to form feet having lower surfaces still covered the lower facing sheet and with resulting feet faces having exposed honeycomb on the surfaces extending upwardly from the covered lower surfaces formed by cutting away portions of said runner blocks, at least one foot cover sheet per covered runner which is folded to cover and which is adherent to the covered lower block surfaces and extends upwardly from those covered lower block surfaces to cover said exposed honeycomb feet surfaces, and at least one conversion sheet which adheres to the portion of the lower facing sheet which is in contact with the honeycomb core deck.

2. The pallet of claim 1 where one or more of the honeycomb core, runner blocks, upper and lower facing sheets, and conversion sheets comprise paper, MYLAR, polyethylene, and clear or fibrous paper form polypropylene.

3. The pallet of claim 2 where the composition of one or more of the honeycomb core, upper and lower facing sheets, and conversion sheets is selected from paper.

4. The pallet of claim 1 in which the upper facing sheet is paper.

5. The pallet of claim 1 in which the upper facing sheet is corrugate having flutes therein.

6. The pallet of claim 5 in which the lower facing sheet is corrugate having flutes therein and in which the flutes in the upper facing are not parallel to the flutes in the lower facing sheet.

7. The pallet of claim 1 in which at least one of the upper facing sheet and lower facing sheet are folded over and adherent to the edge of the honeycomb core and to said at least one of the upper facing sheet and lower facing sheet.

8. The pallet of claim 1 where a substantial portion of cells within the honeycomb core are sealed.

9. The pallet of claim 8 where the runners comprise a laminate corrugate core.

10. The pallet of claim 1 where additional corrugate sheets are adherent to the upper face of the honeycomb core deck.

11. The pallet of claim 1 comprising two or more runners.

12. The pallet of claim 11 where the runners comprise a honeycomb runner core.

13. The pallet of claim 1 in which the conversion sheet comprises two or more sections.

14. The pallet of claim 1 in which the single lower facing sheet extends onto the upper face and adherent to a portion of the honeycomb deck adjacent the honeycomb deck edge.

15. The pallet of claim 14 further comprising a filler sheet adherent to the upper surface of the honeycomb deck not otherwise covered by the lower facing sheet.

16. The pallet of claim 15 further comprising a surface sheet adherent to the filler sheet and the lower facing sheet which is adherent to the upper honeycomb deck surface.

17. The pallet of claim 16 further comprising one or more hard surface sheets adherent to the bottom surfaces of the multiple runner blocks.

* * * * *